US010475310B1

(12) United States Patent
Cheng

(10) Patent No.: US 10,475,310 B1
(45) Date of Patent: Nov. 12, 2019

(54) OPERATION METHOD FOR SECURITY MONITORING SYSTEM

(71) Applicant: Sray-Tech LTD., Taipei (TW)

(72) Inventor: Hsun-Yu Cheng, Keelung (TW)

(73) Assignee: SRAY-TECH IMAGE CO., LTD., Taipei (TW)

( * ) Notice: Subject to any disclaimer, the term of this patent is extended or adjusted under 35 U.S.C. 154(b) by 0 days.

(21) Appl. No.: 16/157,113

(22) Filed: Oct. 11, 2018

Related U.S. Application Data

(60) Provisional application No. 62/683,024, filed on Jun. 11, 2018.

(51) Int. Cl.
*G08B 13/196* (2006.01)

(52) U.S. Cl.
CPC ..... *G08B 13/19608* (2013.01)

(58) Field of Classification Search
CPC ..... G08B 13/19608
See application file for complete search history.

(56) References Cited

U.S. PATENT DOCUMENTS

2017/0186291 A1* 6/2017 Wenus ..... G08B 13/19608
2018/0095057 A1* 4/2018 McQuillen ..... G01N 29/024
2018/0233010 A1* 8/2018 Modestine ..... G08B 13/19671
2019/0019191 A1* 1/2019 Jung ..... G06Q 20/40145
2019/0147676 A1* 5/2019 Madzhunkov ..... G07C 9/00158 340/5.2

FOREIGN PATENT DOCUMENTS

| | | | |
|---|---|---|---|
| CN | 105933650 | A | 9/2016 |
| CN | 206557873 | U | 10/2017 |
| CN | 107331051 | A | 11/2017 |
| TW | 201545126 | A | 12/2015 |

* cited by examiner

*Primary Examiner* — Tracy Y. Li

(74) *Attorney, Agent, or Firm* — Winston Hsu

(57) ABSTRACT

The present invention provides a method of operating a security monitoring system. A security monitoring system is provided, and it includes at least one 2D monitor and a 3D sensor. First, the 2D monitor is activated, when a person is at a first length from the security monitoring system, the person is continuously tracked by the 2D monitor, and when the person continues to approach the security monitoring system, after the person is at a second length from the security monitoring system, the second length is less than the first length, the 3D sensor is activated to receive a facial information of the person, and compared with an authentication data of a database.

12 Claims, 4 Drawing Sheets

OPERATION METHOD FOR SECURITY MONITORING SYSTEM

CROSS REFERENCE TO RELATED APPLICATIONS

This application claims the benefit of U.S. Provisional Application No. 62/683,024, filed on Jun. 11, 2018 and entitled "Intelligent virtual cordon", the contents of which are incorporated herein.

BACKGROUND OF THE INVENTION

1. Field of the Invention

The present invention relates to optics field, and more particularly to an operation method and an application of a security monitoring system including a 3D sensor and a 2D monitor.

2. Description of the Prior Art

As technology advances, machines are gradually replacing human resources and are used in all fields of life. On the other hand, for the security warning system, the current technology has reached that when the camera detects that the person appears within a certain range, the warning can be automatically issued to notify the user.

The passive infrared sensor (PIR sensor), which is widely used in security warning systems, still has some shortcomings. For example, the PIR sensor can only detect whether an object passes through the detecting range, but cannot specifically detect whether the object is a human, an animal, or another movable object. Even if the PIR sensor can be used with a camera, the camera is easily to be affected by ambient light, and in an environment that is too bright or too dark, the screen is unclear. Therefore, currently smart security warning systems still has room for improvement.

SUMMARY OF THE INVENTION

The present invention provides a method of operating a security monitoring system. A security monitoring system is provided, and it includes at least one two-dimension (2D) monitor and a three-dimension (3D) sensor. First, the 2D monitor is activated, when a person is at a first length from the security monitoring system, the person is continuously tracked by the 2D monitor, and when the person continues to approach the security monitoring system, after the person is at a second length from the security monitoring system, the second length is less than the first length, the 3D sensor is activated to receive a facial information of the person, and the facial information is compared with an authentication data of a database.

In the present invention, a new application method is proposed in which a 3D sensor and a 2D monitor (camera) are used together in a security monitoring system. Firstly, the 2D monitor can track the movement of the person, and the 3D sensor is activated when the person is close enough to the 3D sensor, so that the 3D sensor is not required to be continuously turned on, the power saving function can be achieved. Besides, regarding the accuracy for face recognition, the 3D sensor is far better than the 2D monitors, so the security of the system is also improved. In addition, when the security monitoring system of the present invention is applied to an unmanned store, a 3D sensor is disposed near the entrance and/or the exit, it can analyze the gender and the approximate age of the customers, when the customer enters the store, the 2D monitors continuously tracks the customers, so as to obtain the walking trajectories of the customers, therefore, the system can analyze the consumption habits of different ethnic groups.

These and other objectives of the present invention will no doubt become obvious to those of ordinary skill in the art after reading the following detailed description of the preferred embodiment that is illustrated in the various figures and drawings.

DETAILED DESCRIPTION

To provide a better understanding of the present invention to users skilled in the technology of the present invention, preferred embodiments are detailed as follows. The preferred embodiments of the present invention are illustrated in the accompanying drawings with numbered elements to clarify the contents and effects to be achieved.

Please note that the figures are only for illustration and the figures may not be to scale. The scale may be further modified according to different design considerations. When referring to the words "up" or "down" that describe the relationship between components in the text, it is well known in the art and should be clearly understood that these words refer to relative positions that can be inverted to obtain a similar structure, and these structures should therefore not be precluded from the scope of the claims in the present invention.

Figure 1:
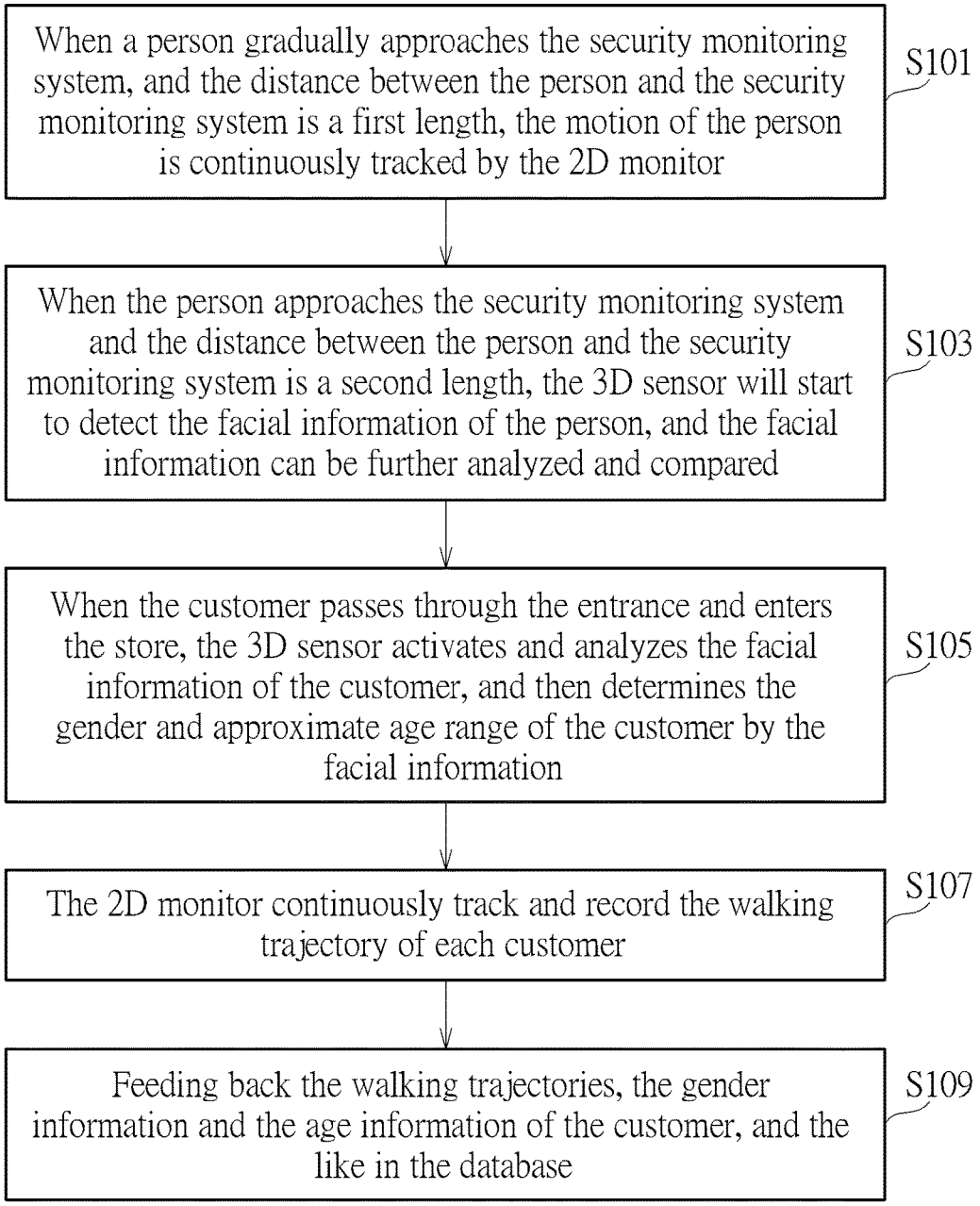
FIG. 1 is a schematic diagram showing the operation of the security monitoring system of the present invention.
Figure 2:
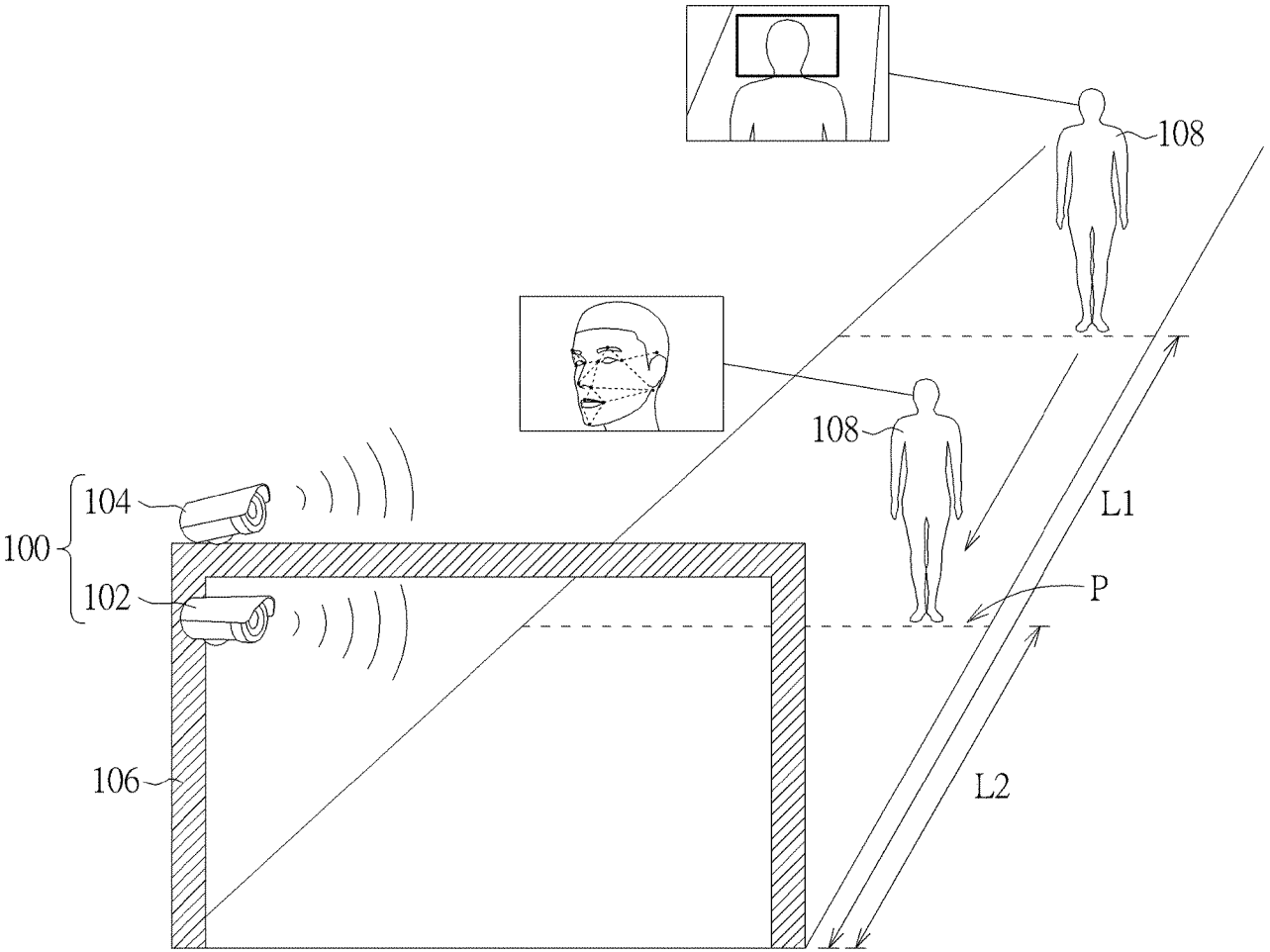
FIG. 2 is a schematic diagram showing the practical application of the security monitoring system of the present invention.

The invention provides a security monitoring system, the security monitoring system is preferably disposed near an entrance and/or an exit of an interior space (not shown). In the present embodiment, the interior space is, for example, a home environment or an unmanned store. Please refer to FIG. 1 to FIG. 2, FIG. 1 is a schematic diagram showing the operation of the security monitoring system of the present invention, and FIG. 2 is a schematic diagram showing the practical application of the security monitoring system of the present invention. As shown in FIG. 1 and FIG. 2, the security monitoring system 100 of the present invention includes at least a three-dimension (3D) sensor 102 and a two-dimension (2D) monitor 104 disposed in a suitable location, such as a gate (entrance) 106 of a home environment or an unmanned store.

The 3D sensor 102 described herein includes a sensor having a detecting function and feeding back a stereoscopic contour or depth of the detected object. In view of the current technology, the 3D sensor 102 may include several devices, such as: 1. the active stereo vision device, the principle of which is to simulate the two eyes of the human body, assisted by a specific pattern light source. The image of the target object is captured by two cameras to calculate the depth of the target object. 2. the structured light device, the principle of which is based on emitting a specific pattern light source. After the light source is reflected by the object, the changing of the pattern light source is calculated, and then analyze the surface contour and the depth of the object. 3. the time of flight (TOF) device, the principle is to emit infrared light, and simultaneously receive the reflected infrared light, calculate the distance of the target by measuring the time difference. Regarding the above three 3D sensor devices, which are known in the art, and the detailed technical contents will not be further described herein. In addition, the present invention is not limited to use the three different 3D sensors devices mentioned above, and other sensors capable of detecting stereoscopic information such as object depth or contour can also be applied to the present invention. As for the 2D monitor 104, for example, a camera, it preferably has a face tracking function, that is, when a person appears in the monitoring range of the camera, the camera can track the walking trajectory (the motion track) of the person, and can record the walking trajectory in a storage space (such as hard disk or cloud space). In addition, the security monitoring system of the present invention can be coupled to a processor (not shown), such as a computer used for recording, comparing, and analyzing the 3D sensor 102, the 2D monitor 104, and information received by other sensors.

In practical applications, please refer to FIG. 1 and FIG. 2, the 2D monitor 104 is in a startup state at any time, and the 3D sensor 102 is preset to be in a sleep state. As step S101 in FIG. 1, when a person 108 gradually approaches the security monitoring system 100, and the distance between the person 108 and the security monitoring system 100 is a first length L1, the motion of the person 108 is continuously tracked by the 2D monitor 104. The first length L1 herein is, for example, 3 meters or other suitable warning length. When the distance between the person 108 and the 2D monitor 104 is the first length L1, the 2D monitor 104 is sufficient to clearly illuminate the body motion and the walking trajectory of the person 108. In this step, the 2D monitor 104 will track the person 108 continuously, and to detect whether the person 108 still approaching the security monitoring system 100. It should be noted that the 3D sensor 102 is not activated at this time, because the 3D sensor 102 needs to emit a high-intensity infrared laser for detection, which consumes more power. Besides, when the 3D sensor 102 is away from the target (for example, more than 3 meters), the accuracy of the detecting is slightly insufficient. Therefore, the 3D sensor 102 of the security monitoring system 100 of the present invention is in a sleep state under normal conditions without being activated, and the 2D monitor 104 is in a state of being activated at any time.

Please refer to FIG. 1 and FIG. 2 again. As shown in step S103, when the person 108 approaches the security monitoring system 100 and the distance between the person 108 and the security monitoring system 100 is a second length L2, the 3D sensor 102 will start to detect the facial information of the person 108, and the facial information can be further analyzed and compared. The second length L2 is, for example, 1.5 meters or other suitable distances. Under the second length L2, the 3D sensor 102 can determine the facial information more clearly, such as the contour or the depth of a human face. When the security monitoring system 100 is applied to the home environment, the facial information of the person 108 can be retrieved and compared with an authentication database to determine whether the person has been authenticated (for example, a household), and then unlocking and/or opening the door. On the other hand, it is also possible to record, notify, and issue an alarm when the authentication is not match. When the security monitoring system 100 is applied to an unmanned store, when the person (customer) 108 enters the store, the person's facial information can be used to determine the approximate age and gender, which are recorded in the data database.

The present invention provides two different methods as to how the security monitoring system 100 determines whether the person 108 has reached a position that is a second length L2 from the gate 106 (as shown at position P in FIG. 2). One method is to set another sensor (not shown) at position P, such as an infrared sensor or the like, and activate the 3D sensor 102 when the person 108 triggers the sensor. Another method is to determine the ratio of the area of the person 108 to the overall screen on the screen of the 2D monitor 104. Furthermore, when the distance between the person and the security monitoring system 100 is the first length L1, the 2D monitor 104 starts to track the movement of the person 108. When the person 108 is closer to the gate (entrance) 106 (or the security monitoring system 100), the screen area occupied by the person 108 in the overall screen of the 2D monitor 104 will become larger, so when the occupied area of the person 108 in the 2D monitor's screen to the overall screen is higher than a certain ratio of area (e.g., one-third or other suitable ratio), it means that the person 108 is sufficiently close to the security monitoring system 100, and the 3D sensor 102 can be activated at this time.

Figure 3:
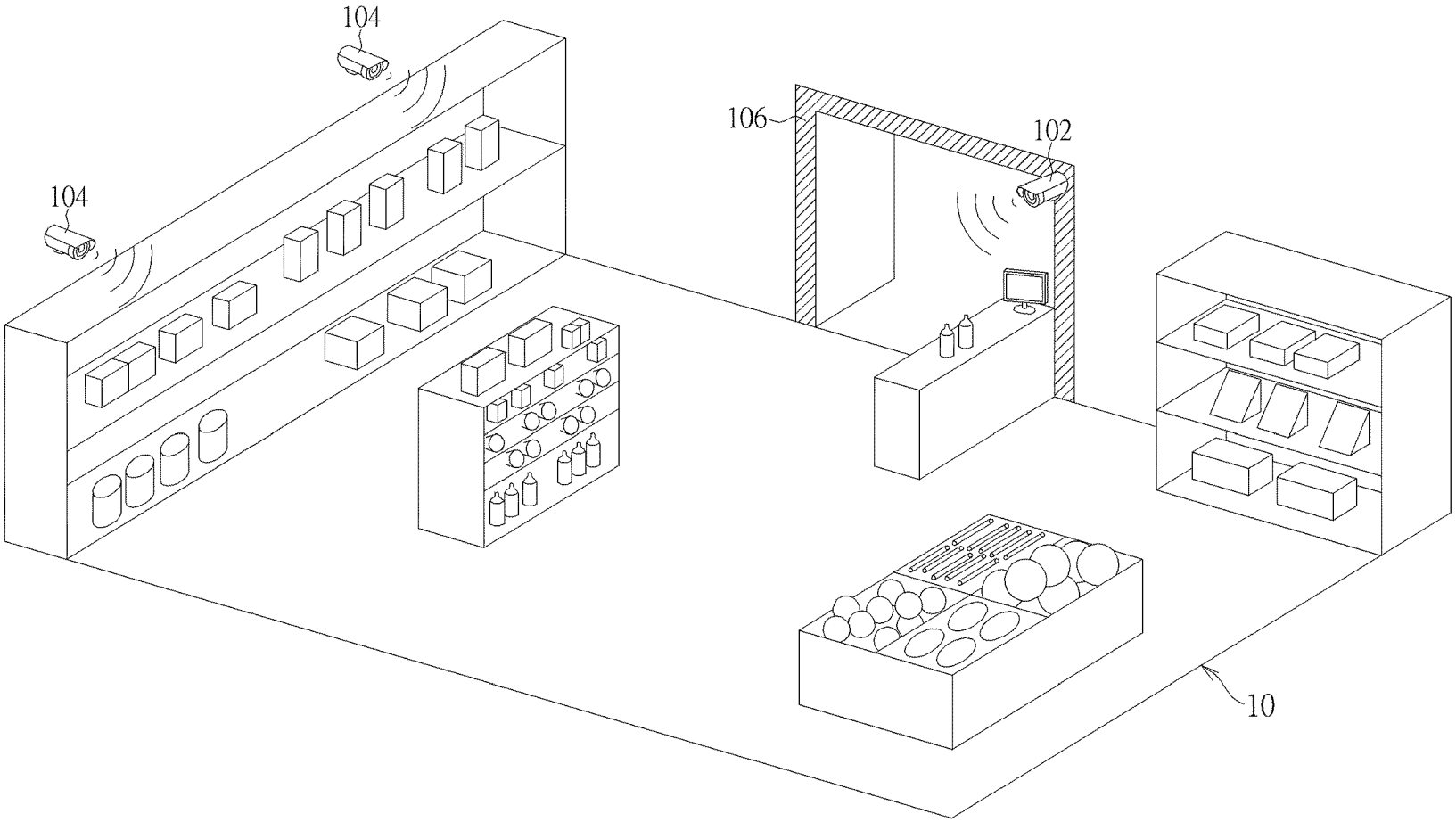
FIG. 3 and FIG. 4 illustrate schematic diagrams of the security monitoring system of the present invention applied to an unmanned store.
Figure 4:
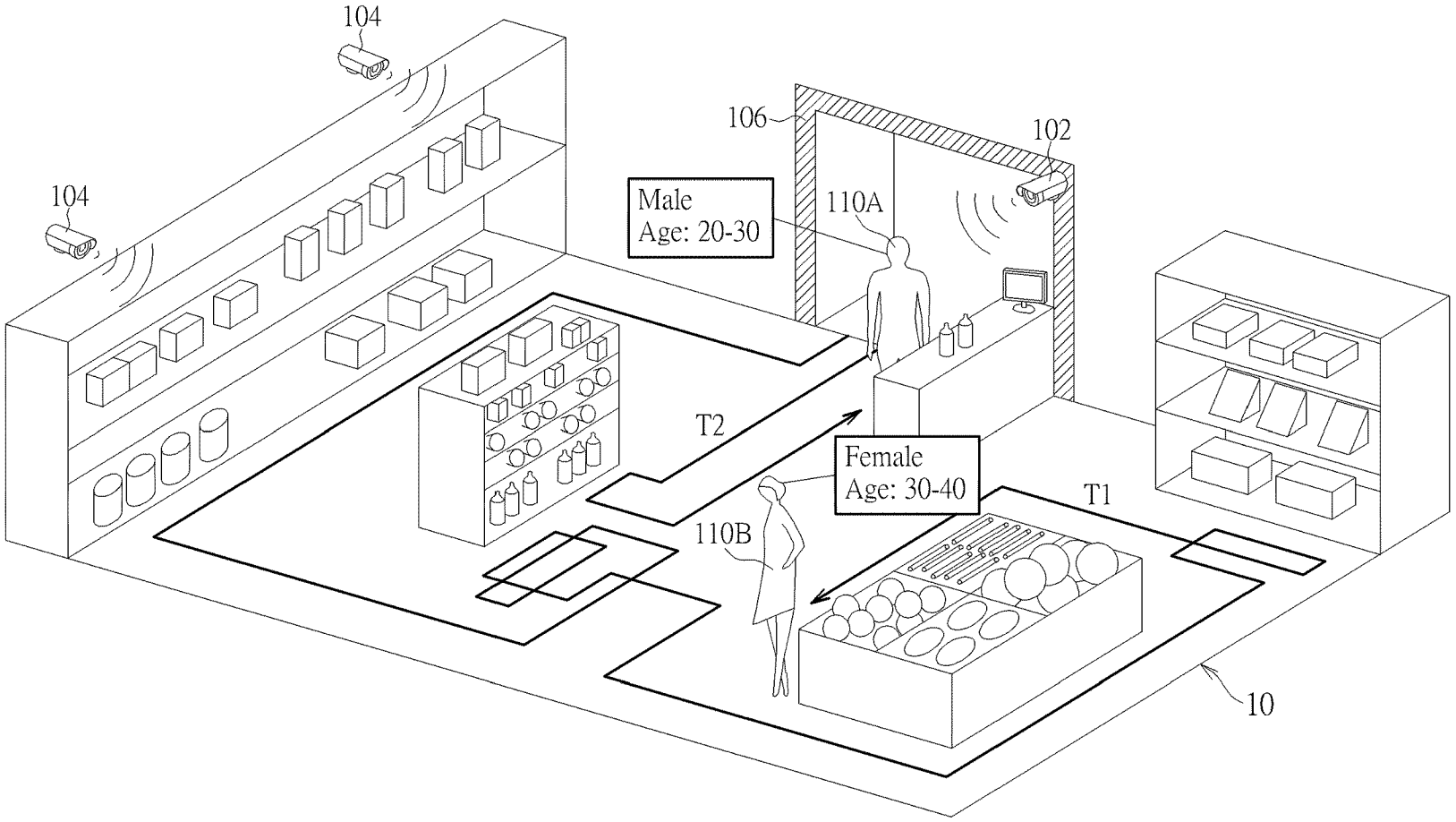

Please refer to FIG. 3 and FIG. 4, which are schematic diagrams showing the application of the security monitoring system of the present invention to an unmanned store. As shown in FIG. 3, here is provided a different application method of the security monitoring system, which can continue the application methods of the above FIG. 1 and FIG. 2. In more detail, the above method sets the security monitoring system near the entrance and the exit of an interior space, and the security monitoring system is set facing toward the outside direction, for example, is can be used for counting the number of visitors outside the store, and the like. When the customer enters the store, the security monitoring system of the present invention can continue to be used, for example, a plurality of 2D monitors 104 are disposed in the unmanned store 10, and are distributed in the space of the store. The 3D sensor 102 mentioned here can be used the same 3D sensor 102 shown in FIG. 2, or the security monitoring system may include a plurality of 3D sensors 102, which are respectively disposed outside the interior space (as shown in FIG. 2) and inside the outside the interior space (as shown in FIG. 3).

As shown in FIG. 1 and FIG. 4, in the application of the present embodiment, since the 3D sensor 102 is disposed near the entrance 106, when the customers 110A, and 110B passes through the entrance 106 and enters the store, as shown in step S105, the 3D sensor 102 activates and analyzes the facial information of the customer, and then determines the gender and approximate age range of the customer via the facial information, and records the facial information in a database (for example, a computer host connected to the security monitoring system). In this way, it can easily know the main customer group of the store. For example, customer 110A in FIG. 4 is a male between the ages of 20 and 30, while customer 110B is a female between the ages of 30 and 40. After the customers enter the store, as shown in step S107, the 2D monitor 104 can continuously track the walking trajectory of each customer, as shown by the walking trajectories T1, T2 shown in FIG. 4. In addition, the walking trajectories T1 and T2 may also include the time taken by the customer staying in each product area. For example, when the trajectory of the customer is displayed on the computer screen, the darker the trajectory color indicates that the customer stays in the product area for a longer time.

The above representation is merely an example, and the present invention is not limited thereto. Therefore, it is possible to determine the consumption behavior of the customers of the age group by the information of the walking trajectories T1 and T2. Next, the walking trajectories, the gender information and the age information of the customer, and the like are then recorded in the database (step S109). In this way, the owner (or the operator) of the unmanned store can understand the preferences of the customer and adjust the positions and the types of products, even if they are not staying in the store.

In addition to this, the 3D sensor 102 disposed near the entrance 106 can also be applied to the function of face scanning payment. For example, when the customer completes the shopping and goes to the counter for checkout, the 3D sensor 102 will scan the facial information and compare it with the member information, and if the information is match, some steps such as collecting member points or paying by the account designated by the member can be performed. This mode of application is also within the scope of the invention.

In summary, the current 3D sensor is mainly used in small electronic devices, such as the face recognition function of a mobile phone or a notebook computer. In the present invention, a new application method is proposed in which a 3D sensor and a 2D monitor (camera) are used together in a security monitoring system. Firstly, the 2D monitor can track the movement of the person, and the 3D sensor is activated when the person is close enough to the 3D sensor, so that the 3D sensor is not required to be continuously turned on, the power saving function can be achieved. Besides, regarding the accuracy for face recognition, the 3D sensor is far better than the 2D monitors, so the security of the system is also improved. In addition, when the security monitoring system of the present invention is applied to an unmanned store, a 3D sensor is disposed near the entrance and/or the exit, it can analyze the gender and the approximate age of the customers, when the customer enters the store, the 2D monitors continuously tracks the customers, so as to obtain the walking trajectories of the customers, therefore, the system can analyze the consumption habits of different ethnic groups.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of operating a security monitoring system, comprising:

providing a security monitoring system, the security monitoring system comprises at least one two-dimension (2D) monitor and a three-dimension (3D) sensor;

activating the 2D monitor when a person is at a first length from the security monitoring system, the person is continuously tracked by the 2D monitor, and wherein the 3D sensor is in a sleep state during this step; and activating the 3D sensor when the person continues to approach the security monitoring system, and after the person is at a second length from the security monitoring system, the 3D sensor receives a facial information of the person, and the facial information is compared with an authentication data of a database, wherein the second length is less than the first length.

2. The method of operating a security monitoring system of claim 1, wherein the security monitoring system is disposed at a gate.

3. The method of operating a security monitoring system of claim 2, wherein the facial information is compared with the authentication data of a database, an authentication step is then performed, and when the authentication is matched, the gate is opened.

4. The method of operating a security monitoring system of claim 2, wherein the facial information is compared with the authentication data of a database, an authentication step is then performed, and when the authentication is not matched, a recording step and a notification step are performed.

5. The method of operating a security monitoring system of claim 2, wherein the security monitoring system further comprises a plurality of second 2D monitors disposed in an interior space, wherein the gate is an entrance or an exit of the interior space.

6. The method of operating a security monitoring system of claim 5, where the interior space comprises an unmanned store.

7. The method of operating a security monitoring system of claim 5, further comprising:

activating the plurality of second 2D monitors when the person passes through the gate and enters the interior space, to obtain a walking trajectory of the person.

8. The method of operating a security monitoring system of claim 7, further comprising feeding back the walking trajectory to a second database.

9. The method of operating a security monitoring system of claim 8, further comprising:

obtaining an age information and a gender information by the facial information, and feeding back the age information and the gender information to the second database.

10. The method of operating a security monitoring system of claim 1, wherein the 3D sensor comprises an active stereo vision device, a structured light device or a time of flight (TOF) device.

11. The method of operating a security monitoring system of claim 1, wherein the first length is greater than 3 meters.

12. The method of operating a security monitoring system of claim 1, wherein the second length is less than 1.5 meters.

* * * * *